US007228826B2

(12) United States Patent
Chang

(10) Patent No.: US 7,228,826 B2
(45) Date of Patent: Jun. 12, 2007

(54) INTERNAL COMBUSTION ENGINE VALVE SEATING VELOCITY CONTROL

(75) Inventor: David Yu-Zhang Chang, Lawrenceville, GA (US)

(73) Assignee: Caterpillar Inc, Peoria, IL (US)

( * ) Notice: Subject to any disclaimer, the term of this patent is extended or adjusted under 35 U.S.C. 154(b) by 248 days.

(21) Appl. No.: 10/926,496

(22) Filed: Aug. 26, 2004

(65) Prior Publication Data

US 2005/0132987 A1 Jun. 23, 2005

Related U.S. Application Data

(63) Continuation-in-part of application No. 10/743,000, filed on Dec. 23, 2003, now Pat. No. 6,988,471.

(51) Int. Cl.
*F01L 9/02* (2006.01)

(52) U.S. Cl. ..... 123/90.12; 123/90.13; 251/12

(58) Field of Classification Search ..... 123/90.12, 123/90.13; 251/12, 14; 92/109, 110, 111, 92/112; 91/420, 421, 422, 423
See application file for complete search history.

(56) References Cited

U.S. PATENT DOCUMENTS 5,421,359 A 6/1995 Meister et al.
5,460,131 A 10/1995 Usko
5,577,468 A * 11/1996 Weber ..... 123/90.12
5,606,940 A 3/1997 Shafer et al.
6,192,841 B1 2/2001 Vorih et al.
6,302,370 B1 10/2001 Schwoerer et al.
6,474,277 B1 11/2002 Vanderpoel et al.
6,550,433 B2 4/2003 Vorih et al.
6,668,773 B2 * 12/2003 Holtman et al. ..... 123/90.12
7,069,887 B2 * 7/2006 Cornell et al. ..... 123/90.12

FOREIGN PATENT DOCUMENTS

DE 4443169 A1 * 6/1996

* cited by examiner

*Primary Examiner*—Ching Chang
(74) *Attorney, Agent, or Firm*—Liell & McNeil

(57) ABSTRACT

The present disclosure provides an engine having a gas exchange valve and an actuator for the gas exchange valve, and also a method of reducing valve seating impact velocity. The actuator includes a body having a fluid inlet and a fluid outlet. A plunger is reciprocable in the body and has a travel distance between an advanced position and a retracted position, the plunger and body defining a chamber. A flow restriction orifice is disposed in at least one of the plunger and the body, and the chamber is in unrestricted fluid communication with the outlet over a first portion of the travel distance and in restricted fluid communication with the outlet by way of the orifice over at least a second portion of the travel distance.

17 Claims, 4 Drawing Sheets

INTERNAL COMBUSTION ENGINE VALVE SEATING VELOCITY CONTROL

CROSS-REFERENCE TO RELATED APPLICATION

This Application is a Continuation-in-Part of U.S. patent application Ser. No. 10/743,000, filed Dec. 23, 2003 now U.S. Pat. No. 6,988,471, and entitled Engine Valve Actuation System.

TECHNICAL FIELD

The present disclosure relates generally to internal combustion engine valve assemblies, and more particularly to a snubber for controlling seating impact velocity of a gas exchange valve in an internal combustion engine.

BACKGROUND

Excessive valve seating impact velocity is a problem familiar to many hydraulic system designers. In many modern applications, high speed hydraulic valves and related components may reciprocate many times per second. In order to generate such rapid action, the system components are often driven with relatively high forces. When a valve impacts its seat at too high a velocity, the seat and/or the valve itself can be damaged, compromising the sealing ability of the valve and in some instances rendering the valve inoperable.

A gas exchange valve in an internal combustion engine typically moves rapidly back and forth between an open position for intake or exhaust strokes, and a closed position during compression and power strokes. Repeated impacts of the valve against its seat can deform, break or otherwise damage the components, causing gases to leak past the valve seat when closed or worse, breaking the valve altogether. Disruptions in gas exchange during engine operation can result in sub-optimal engine performance. In more exotic engine operation schemes, proper valve seating can be critical to achieving a desired engine performance.

Valve "snubbers" are a class of hydraulic apparatuses addressing problems similar to those discussed above. Snubbing devices of varying complexity have been developed over the years. However, the small, rapidly moving hydraulic parts from some known systems must often be machined to very close tolerances, making mass production challenging and expensive. Moreover, during cold start conditions it can be difficult to initiate operation of a hydraulic system having numerous small parts bathed in cold, viscous oil.

One snubber system is known from U.S. Pat. No. 5,577,468 to Weber. Weber describes a hydraulic snubber for controlling engine valve seating velocity. In the Weber design a plunger is operably coupled to a gas exchange valve in an engine, and reciprocates in a housing between an advanced position and a retracted position. Weber's snubber includes a machined plate positioned above the plunger and having a first position during extension of the plunger, and a second position during retraction of the plunger. In the snubber plate's first position, it allows actuation fluid to be delivered to the plunger through a set of passages having a given flow area, whereas in the snubber's second position it restricts the available flow area to a single, relatively smaller passage for evacuation of actuation fluid. The smaller flow path determined by the position of the plate appears to slow the plunger as it approaches a seat, also reducing the seat impact velocity of the valve member coupled to the plunger.

Although the Weber design is believed to function effectively there is always room for improvement. In particular, Weber requires a relatively large number of parts for its snubber assembly.

The present disclosure is directed to one or more of the problems or shortcomings set forth above.

SUMMARY OF THE INVENTION

In one aspect, the present disclosure provides an engine. The engine includes a gas exchange valve movable a travel distance from a seat. A rocker arm is provided and operably coupled to the gas exchange valve. A cam is operably coupled to the rocker arm, and a hydraulic actuator is operably coupled to the gas exchange valve. The hydraulic actuator includes a snubber operable over a portion of the travel distance.

In another aspect, the present disclosure provides an actuator for a gas exchange valve. The actuator includes a body having a fluid inlet and a fluid outlet. A plunger is reciprocable in the body and has a travel distance between an advanced position and a retracted position, the plunger and body defining a chamber. A flow restriction orifice is disposed in at least one of the plunger and the body. The chamber is in unrestricted fluid communication with the outlet over a first portion of the travel distance and in restricted fluid communication with the outlet by way of the orifice over at least a second portion of the travel distance.

In yet another aspect, the present disclosure provides a method of reducing valve seating impact velocity. The method includes the steps of operably coupling a valve to a hydraulic actuator that includes a plunger, and moving the valve toward its seat at least in part by expelling fluid through an unrestricted passage in a body. The method further includes the step of slowing the valve as it approaches its seat at least in part by expelling the fluid through a restricted passage disposed in at least one of the body and the plunger.

DETAILED DESCRIPTION

Figure 1:
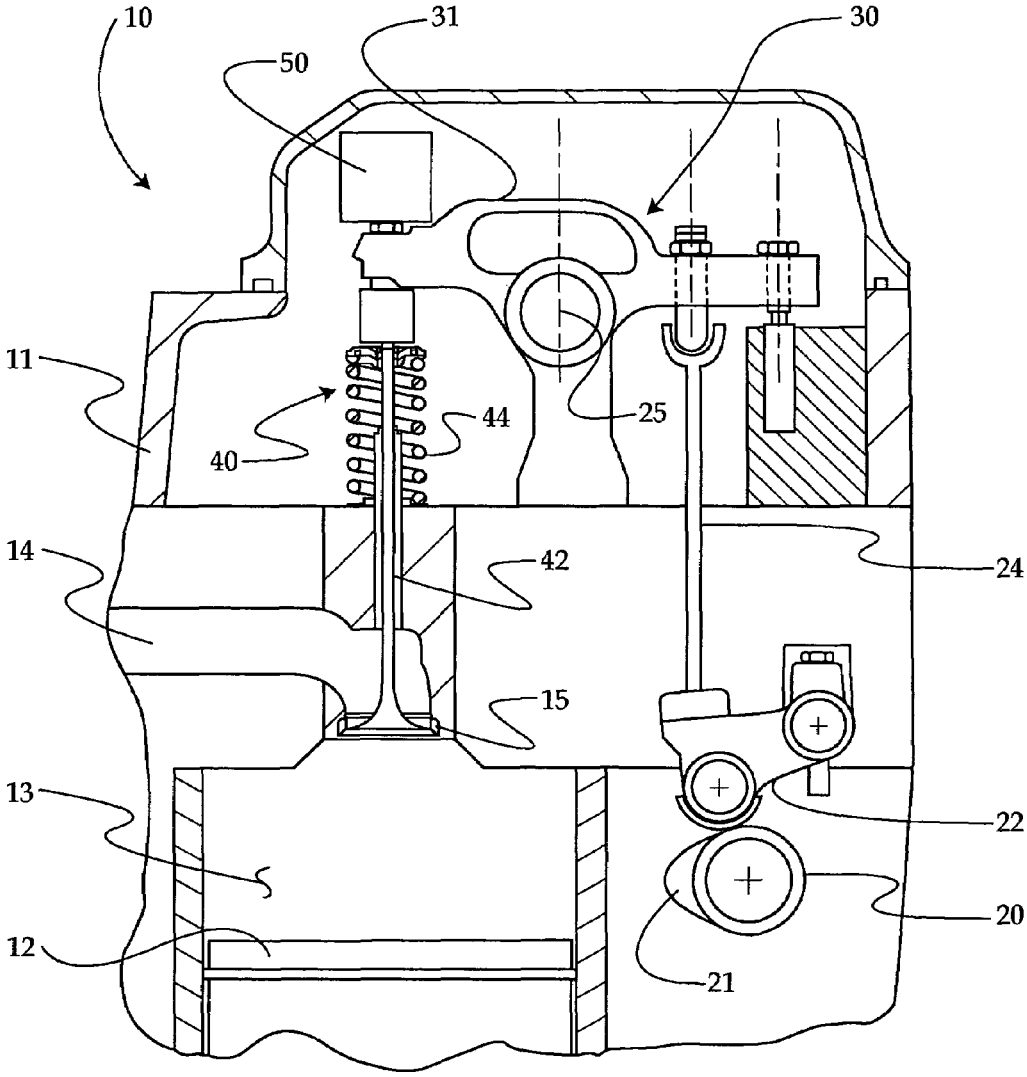
FIG. 1 is a partially sectioned diagrammatic side view of an engine having a gas exchange valve.

Referring to FIG. 1, there is shown an engine 10 in accordance with a preferred embodiment of the present disclosure. Engine 10 includes an engine housing 11 defining a cylinder 13 within which a piston 12 is reciprocable. Engine 10 may be any internal combustion engine; it is contemplated that in a preferred embodiment engine 10 will be a compression ignition engine such as a conventional diesel engine, and may be operable as a homogeneous charge compression ignition diesel engine. Engine 10 further provides a gas exchange valve assembly 40 having a gas exchange valve member 42 that reciprocates between an open position and a closed position, as depicted in FIG. 1, the valve member being biased toward its closed position with a return spring 44. A gas exchange passage 14 is further defined by engine housing 11, and may be either of an exhaust passage for expelling combustion products, or an intake passage supplying air for combustion with fuel.

In a preferred embodiment, gas exchange valve member 42 is movable between its open and closed positions with a rocker arm assembly 30. Rocker arm assembly 30 preferably includes a rocker arm 31 that tilts back and forth about a pivot point 25. A connecting rod 24 is preferably coupled to rocker arm assembly 30 and reciprocates under the action of a cam follower 22, which is in turn driven by a cam 20 coupled to engine operation in a conventional manner.

A variable timing actuator assembly 50 is further preferably provided, and is operable to control the extension and retraction of valve member 42, as described herein. Actuator assembly 50 includes an actuator of the snubbing type such that upon return of valve member 42 toward a seat 15, the velocity of valve member 42 can be reduced. In some applications, actuator assembly 50 allows the valve to be opened before its cam dictated opening timing and/or be closed after a cam dictated closing timing. Cam 20 and actuator assembly 50 are coupled to rocker arm 31 at different locations so as to be independent from one another. In the illustrated example, actuator assembly 50 includes an intake valve actuator that operates at hydraulic pressures insufficient to open the gas exchange valve against the action of return spring 44. However, control valve 78 allows the actuator assembly 50 to go into a hydraulic lock to hold gas exchange valve 40 open beyond its cam dictated closing timing. This allows engine 10 to effectively operate in the so called Miller Cycle. Thus, in the illustrated example hydraulic pressure is sufficient to displace plunger 51 but not sufficient to open the gas exchange valve 40 against cylinder pressure and/or a return spring force. In other applications with higher hydraulic pressures and inclusion of an admission/drain valve, the gas exchange valve can be opened at any desired timing. Such systems may or may not include cam actuation fixed timing events.

Figure 2:
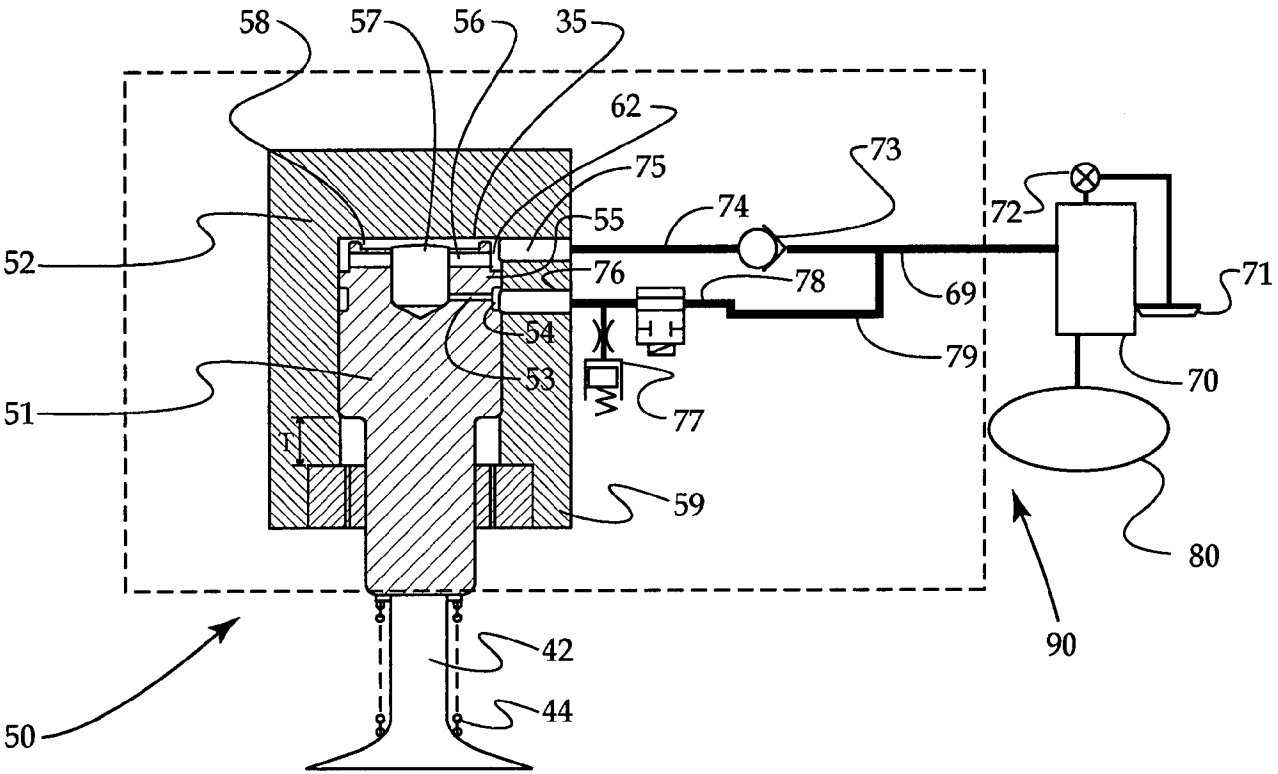
FIG. 2 is a diagrammatic view of an actuator assembly for a gas exchange valve.

Turning now to FIG. 2, there is shown an actuator assembly 50, and an associated hydraulic system 90 operating actuator assembly 50 at least in part. Actuator assembly 50 is preferably operably coupled to an engine gas exchange valve, for example, including an engine intake valve member 42. Actuator assembly 50 preferably includes a valve body 52 having a reciprocable plunger 51 positioned therein. In a preferred embodiment, plunger 51 has a travel distance "T", and is operably coupled to a valve member 42 similar to the valve member described with regard to FIG. 1. Travel distance T is defined by motion of plunger 51 between its retracted position, shown in FIG. 2, and an extended position at which plunger 51 abuts a stopper 59, which is preferably threadedly engaged with body 52. Stopper 59 may be equipped with one or more drain passages 61 to allow fluid to drain there through as plunger 51 advances, if necessary. Plunger 51 and valve body 52 preferably define a chamber 35 that can fill with hydraulic fluid from rail 70 as plunger 51 traverses travel distance T toward an advanced position, and preferably is drained substantially of hydraulic fluid as plunger 51 returns toward a retracted position. Valve member 42 is preferably operably coupled also to a rocker arm (not shown in FIG. 2) such as rocker arm 31 of FIG. 1.

Operation of actuator assembly 50 is preferably controlled at least in part by hydraulic system 90. Hydraulic system 90 preferably includes a high pressure hydraulic actuation fluid source such as an oil rail 70, providing high pressure hydraulic fluid for the actuation of actuator assembly 50. It is contemplated that engine 10 will most preferably operate with a common rail system such as are well known in the art, however, it should be appreciated that another suitable hydraulic actuation fluid system might be used. Further, those skilled in the art will appreciate that any hydraulic fluid might be used such as engine oil, transmission oil, engine coolant, fuel, etc. without departing from the intended spirit and scope of the appended claims. An oil rail control valve 72 preferably selectably connects rail 70 with a low pressure drain 71, allowing the pressure of hydraulic fluid in rail 70 to be adjusted as desired, or drained for servicing. Under normal operating conditions, control valve 72 is closed. Rail 70 is further preferably connected to a main oil gallery 80, including various other conventional components (not shown) of a common rail system in an internal combustion engine.

An oil conduit 69 extends from rail 70, and preferably divides into a supply passage 74 and a drain passage 79. Although a single passage that splits into two represents one preferred design, those skilled in the art will appreciate that other designs might be used without departing from the scope of the present disclosure. A one-way check valve 73, preferably a ball check, is positioned in supply passage 74 and permits hydraulic oil to flow from rail 70 to actuator assembly 50, but blocks flow in the reverse direction from actuator assembly 50 toward rail 70. Supply passage 74 connects to a fluid inlet 75, preferably defined by valve body 52. A fluid outlet 76 is further preferably defined by valve body 52 and fluidly connects with drain passage 79. In a preferred embodiment, a pressure accumulator 77, for example a spring biased accumulator, is connected to drain passage 79, limiting hydraulic pressure spikes and pressure waves in system 90. Downstream from valve body 52 (toward rail 70), drain passage 79 is preferably equipped with a two-way control valve 78, normally biased in an open position. Control valve 78 may be closed to block fluid flow from actuator assembly 50 toward rail 70, such as to hydraulically lock the gas exchange valve open beyond its cam dictated closing timing. In a preferred embodiment, control valve 78 is operated with an electronic control module (not shown). The coupling between plunger 51 and valve member 42 is preferably designed such that the degree of "lash" between the parts, is conventional.

Plunger 51 preferably includes a plurality of internal passages. A flow restriction orifice 53 is preferably defined by plunger 51 and fluidly connects chamber 35 with an annulus 54 formed peripherally about plunger 51. A cavity 57 is preferably formed substantially coaxially with plunger 51 and provides a portion of the fluid connection between chamber 35 and annulus 54. A plurality of radial passages 56, preferably four radially symmetrical passages are further preferably defined by plunger 51 and fluidly connect inlet 75 with cavity 57 and/or chamber 35. A bore 58 is preferably formed coaxially with cavity 57, and includes a relatively larger diameter than cavity 57. Bore 58 and cavity 57 preferably provide pressure surfaces whereby hydraulic actuation fluid from rail 70 can act on plunger 51 to urge the same toward an advanced position. In a preferred embodiment, coupling of plunger 51 to valve member 42, in turn preferably coupled to rocker arm 26, allows both hydraulic actuation fluid from rail 70 and the extending force from coupled valve member 42 to urge plunger 51 toward an advanced position. One way check valve 73 allows pressurized hydraulic fluid to flow via passage 74 and inlet 75 into chamber 35 for this purpose.

As plunger 51 advances in body 52, hydraulic fluid enters chamber 35. Upon retraction of valve member 42 check valve 73 ensures that the expulsion of fluid from chamber 35 may take place only through passage 79 via outlet 76.

Expulsion of fluid through passage 79 is in turn controlled by the state of valve 78 and accordingly, valve 78 (normally open) can be closed to halt expulsion of fluid and retraction of both plunger 51 and valve member 42, coupled thereto. In a preferred embodiment, return spring 44 urges valve member 42 and plunger 51 toward a retracted position. Following opening of valve assembly 40 with cam 20, return spring 44 will normally push valve member 42 and plunger 51 to a retracted position, expelling fluid from chamber 35 unless valve 78 is closed to block fluid drain passage 79. A metering edge 55 is located on plunger 51, blocking an unrestricted passage 62 along a portion of travel distance T, and opening unrestricted passage 62 along a portion of travel distance T. Flow restriction orifice 53 preferably provides fluid communication between chamber 35 and outlet 76 along at least a portion of travel distance T.

Figure 7:
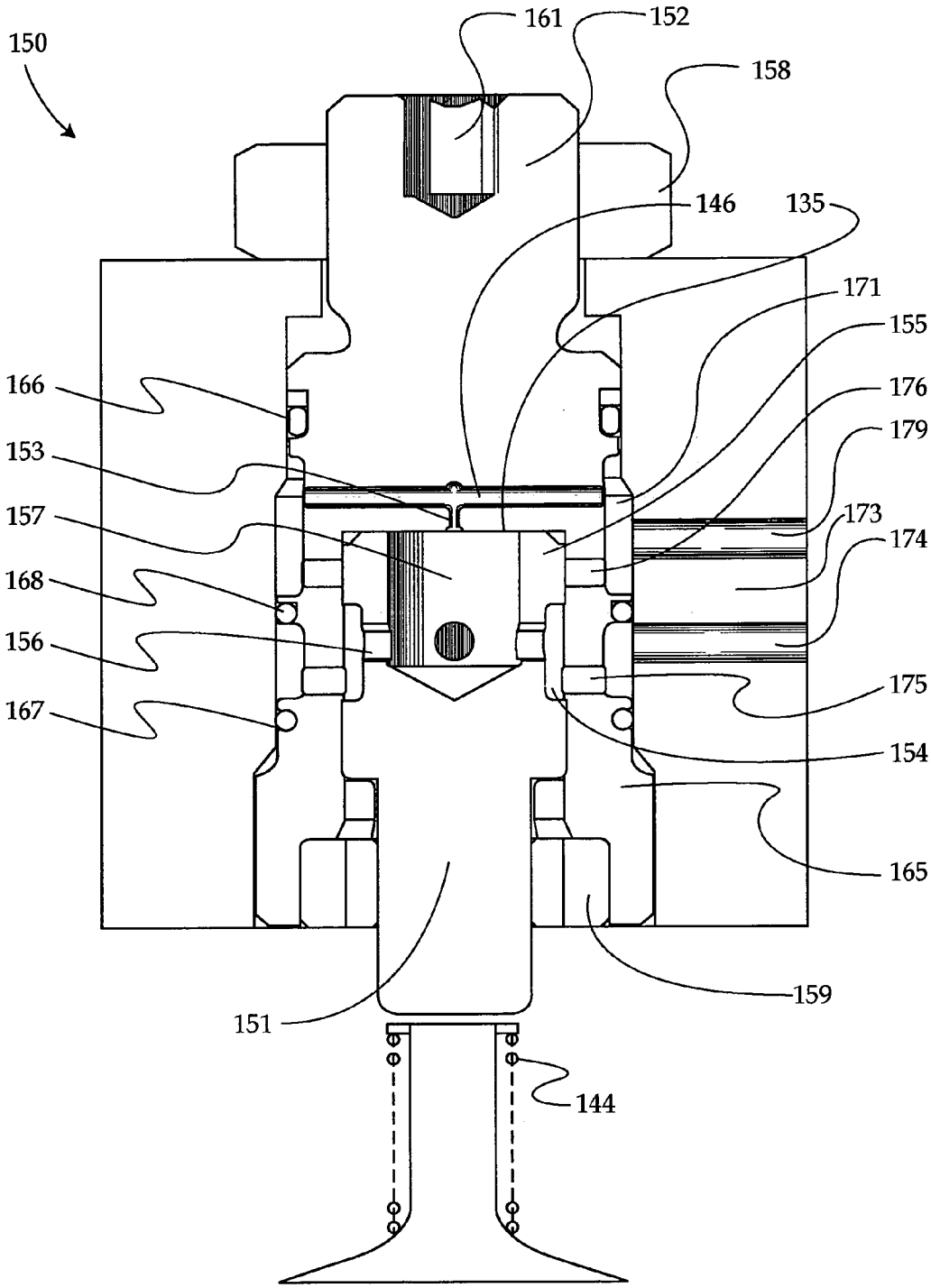
FIG. 7 is a side diagrammatic view of an alternative actuator assembly for a gas exchange valve.

Turning to FIG. 7, there is shown an alternative design for a valve actuator assembly 150 suitable for use in the engine and actuator systems described herein. Actuator assembly 150 includes a housing 173 within which a valve body 152 is positioned. A plunger 151 is reciprocable in body 152 between an advanced position at which it abuts a stop 159, and a retracted position, shown in FIG. 8. Valve body 152 is preferably retained in housing 173 with a threaded collar 153 that is engaged with a threaded head portion 161 of said body 152, providing a relatively simple method of assembly. For example, during assembly, valve body 152 is first positioned within a bore 171 in housing 173, threadedly engaged with collar 153, and then drawn to the desired position within bore 171 by rotating collar 153. A shoulder 165 on body 152 is preferably provided and abuts against a portion of housing 173 when body 152 reaches the desired position. Actuator assembly 150 may be disassembled by loosening collar 153 about head portion 161 and pushing body 152 from bore 171.

A plurality of annular seals, for example first 166, second 167 and third 168 seals, are preferably positioned between body 152 and housing 174. The seals may be formed, for example, by conventional O-rings seated on body 152 and fluidly sealing against an inside wall of bore 171. Alternatives are contemplated, however, wherein a different seal design or different number or position of the seals is employed.

A fluid supply passage 174 is defined by housing 173 and preferably opens to bore 171 at a first side of third seal 168, providing a supply of hydraulic actuation fluid to actuator assembly 150 in a manner similar to that described with respect to actuator assembly 50 above. Valve body 152 defines a fluid inlet 175, preferably a plurality of fluid inlets radially arranged there about, and supplies actuation fluid from supply passage 174 to an annulus 154 extending peripherally about plunger 151. Plunger 151 in turn defines at least one internal passage 156, preferably a plurality of radially arranged internal passages that communicate fluid to an internal cavity 157 defined by plunger 151 and oriented substantially coaxially therewith. Similar to the embodiment depicted in FIGS. 2–6, plunger 151 and valve body 152 define a chamber 135 there between that can fill with hydraulic fluid as plunger 151 travels to an advanced position (not shown). A fluid outlet 176 is further preferably defined by valve body 152 and fluidly connects chamber 135 with bore 171 at a second side of third seal 168. A fluid drain passage 179 is further defined by housing 174 and provides a fluid drain from actuator assembly 150 in a manner similar to that described with respect to the embodiment of FIGS. 2–6.

Plunger 151 further includes a metering edge 155 extending peripherally there about, and positioned adjacent annulus 154. In the retracted position of plunger 151, shown in FIG. 8, fluid communication between supply passage 174 and drain passage 176 is blocked. As plunger 151 is advanced, however, metering edge 155 will pass fluid outlet 176, opening fluid communication between chamber 135 and fluid outlet 176. As a result, fluid communication is opened between supply passage 174 and drain 179 via the internal plumbing of plunger 151.

A flow restriction orifice 153 is defined by valve body 152, and preferably positioned adjacent chamber 135, providing continuous fluid communication between chamber 135 and fluid drain passage 179. During retraction of plunger 151, fluid will be initially expelled from chamber 135 directly through outlet 176. When metering edge 155 begins to obscure fluid outlet 176, the available flow area for expelling fluid from chamber 135 will decrease. Once metering edge 155 has completely obscured outlet 176, the sole exit for fluid from chamber 135 will be via flow restriction orifice 153. The control valves, check valves, dampers, and hydraulic system depicted in FIG. 2 may be suitably applied to actuator assembly 150 in a manner similar to that described with respect to actuator assembly 50 to control the position of actuator 151 and an associated gas exchange valve.

INDUSTRIAL APPLICABILITY

FIG. 1 illustrates valve member 42 in a retracted position, such as it would occupy when gas exchange passage 14 is blocked from cylinder 13 during engine operation. Valve member 42 is biased toward its retracted position with return spring 44, rocker arm 31 is pivoted about pivot point 25 to a rest position and cam follower 22 is rotating against cam 20. As cam 20 continues to rotate, an elevated cam lobe 21 engages against cam follower 22, driving connecting rod 24 against rocker arm 31. Rocker arm 31 begins to pivot about pivot point 25 and exerts a downward force on valve member 42, overcoming the force of return spring 44 to initiate opening of gas exchange passage 14.

In a typical four cycle engine, it is desirable to block passage 14 with valve member 42 during at least a portion of the compression stroke and the ignition stroke. Accordingly, the radial orientation, elevation and slope of cam lobe 21 are selected to correspond with a desired opening time, magnitude and flow rate for gas exchange passage 14, in a conventional manner. In more exotic engine operation schemes, passage 14 might be momentarily blocked or opened during additional periods in the engine operation cycle.

Figure 3:
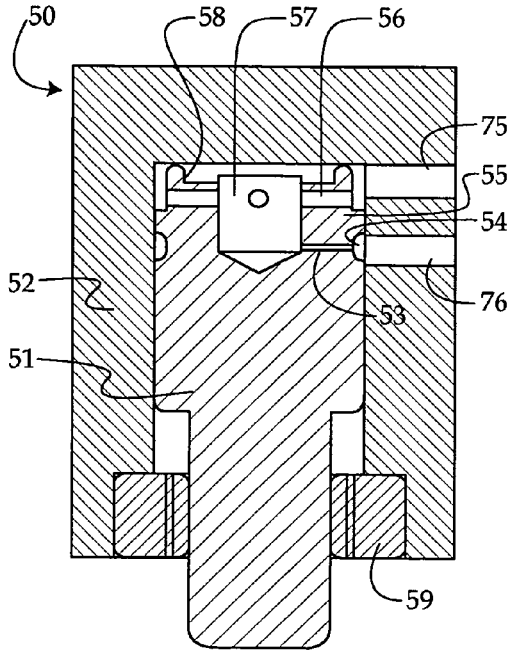
FIGS. 3–6 are side diagrammatic views of a plunger positioned in a valve body, illustrating the plunger at several positions over its travel distance.

FIGS. 2 and 3 illustrate the components and state of actuator assembly 50 and the associated hydraulic control system as it would approximately appear just prior to initiation of a gas exchange event. Rail 70 is charged with pressurized hydraulic fluid, oil rail control valve 72 is closed, and high pressure oil is incident at inlet 75 via supply passage 74 and through check valve 73. Control valve 78 is open, providing pressurized hydraulic fluid to outlet 76. Recalling, in this example hydraulic pressure is not sufficient to move the gas exchange valve open against spring 44. Inlet 75 is in fluid communication with outlet 76 via the internal plumbing of plunger 51. As cam lobe 21 encounters cam follower 22, valve member 42 will begin to move downward relative to valve body 52, also drawing plunger 51 downward and allowing hydraulic fluid to flow into chamber 35, the hydraulic fluid assisting in urging plunger 51 toward its advanced position.

Figure 5:
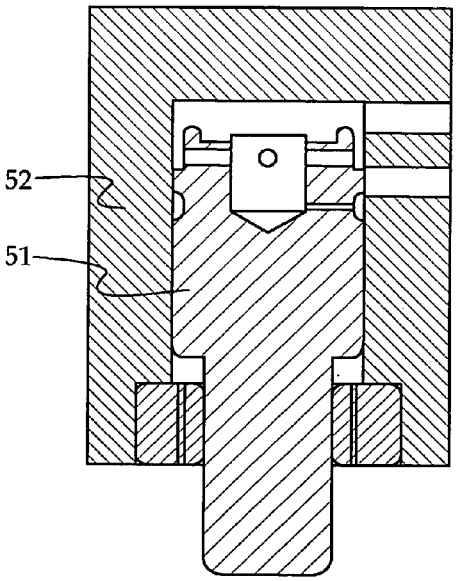
Figure 6:
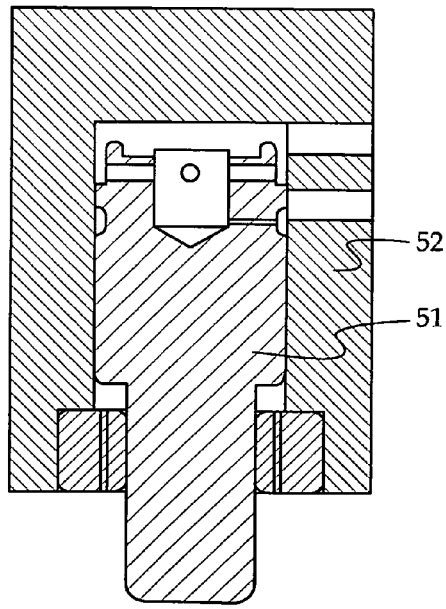

Under the action of cam 20 and hydraulic fluid in chamber 35, plunger 51 will preferably travel toward its advanced position against stop 59, as illustrated in FIG. 5, traversing travel distance T. As cam 20 continues to rotate, the peak of cam lobe 21 will pass cam follower 22, and allow return spring 44 to begin to urge plunger 51 back toward its retracted position. As plunger 51 retracts, hydraulic fluid is expelled from chamber 35 via outlet 76 and through supply passage 79 and control valve 78.

Under certain circumstances it may be desirable to hold valve member 42 in an open position longer than would otherwise occur relying on the action of cam 20 and return spring 44 alone. If it is desirable, for example, to hold valve member 42 at an advanced position or momentarily halt its return toward its retracted position, control valve 78 can be closed to block fluid expulsion from chamber 35. The engine electronic control module (not shown) is preferably utilized to close or open valve 78 to adjust the timing of the gas exchange event as desired.

Return spring 44 is typically relatively stiff, having a tendency to accelerate valve member 42 and plunger 51 relatively rapidly toward their retracted positions once cam 20 ceases to urge the same toward their respective advanced positions. Engine 10 is typically provided with a seat 15 against which valve member 42 rests to block gas exchange passage 14 from cylinder 13. During operation of a typical internal combustion engine, various of the engine valves may impact their seats many times. When such impacts take place at relatively high velocities damage to the seat and/or the valve member can take place, disrupting the desired operation scheme and potentially rendering the entire engine inoperative. Actuator assembly 50 minimizes damage to seat 15 by restricting the flow of hydraulic fluid from chamber 35 as plunger 51 approaches its retracted position.

Figure 4:
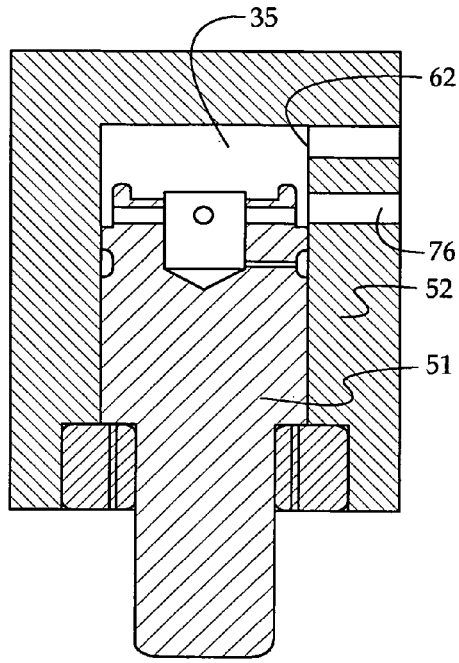

When plunger 51 begins to travel toward its retracted position, fluid is initially expelled through a relatively unrestricted passage 62, defined in part by plunger 51 and also in part by valve body 52. Thus, as shown in FIG. 4, hydraulic fluid can at this point flow directly from chamber 35 to outlet 76. Plunger 51 is preferably formed having an outer diameter at the end proximate chamber 35 that is less than an inner diameter of valve body 52, allowing fluid flow there between. Metering edge 55 preferably has an outer diameter providing a match clearance with valve body 52, blocking fluid flow between metering edge 55 and valve body 52. As plunger 51 continues retracting, metering edge 55 begins to obscure fluid outlet 76, restricting fluid flow across unrestricted passage 62, approximately as shown in FIG. 5. The reduced flow area of passage 62 reduces the rate at which fluid can be expelled from chamber 35 as return spring 44 urges plunger 51 back toward its retracted position. The velocity of plunger 51 is thus reduced as it retracts, slowing valve member 42, coupled thereto.

Further retraction of plunger 51 brings metering edge 55 completely past outlet 76, blocking fluid communication via passage 62 between outlet 76 and chamber 35. Flow restriction orifice 53 fluidly connects chamber 35 with outlet 76; following the blocking of passage 62 by metering edge 55, orifice 53 provides the sole path for fluid to be expelled to outlet 76 from chamber 35 as shown in FIG. 7, further slowing retraction of plunger 51 and valve member 42.

Annulus 54 preferably opens fluid communication between chamber 35 and outlet 76 via orifice 53 slightly prior to the point at which metering edge 55 blocks passage 62, however, those skilled in the art will appreciate that orifice 53 might provide continuous fluid communication between chamber 35 and outlet 76. In alternative embodiments, annulus 53 might be omitted from the design altogether.

Operation of engine 10 with an actuator assembly such as actuator assembly 150 of FIG. 8 is similar to operation of engine 10 with actuator assembly 50, and reference is made to the foregoing description. A primary difference relates to the positioning of the flow restriction orifice, which is defined by plunger 51 of actuator assembly 50, but defined by valve body 152 of actuator assembly 150. It should be noted that embodiments are contemplated (not shown) wherein a flow restriction orifice is located in both of the plunger and the valve body. In actuator assembly 150, return of plunger 151 to its retracted position takes place initially by expelling fluid from chamber 135 directly through outlet 176. A metering edge 155 closes outlet 176 as plunger 151 retracts, similar to operation of actuator assembly 50, leaving flow restriction orifice 153 as the sole path for expelling fluid from chamber 135.

A further distinction between actuator assemblies 50 and 150 relates to the positioning of the fluid inlet and fluid outlet in the respective embodiments. For instance, in actuator assembly 50 the fluid supply passage 74 provides pressurized hydraulic fluid directly to chamber 35 via inlet 75, whereas in actuator assembly 50 fluid inlet 175 provides actuation fluid to chamber 135 via the internal plumbing of plunger 151.

The presently disclosed embodiments thus provide a design and method for reducing valve seating impact velocity. The disclosed concepts are also well suited to an application where it is desirable to initiate the snubbing function of a valve actuator under cold start conditions. The use of internal plumbing in the plunger 51, 151 to fill actuation chamber 35, 135 and the positioning of a flow restriction orifice 53, 153 in one or both of the valve body 52, 152 provides a sufficiently large flow area to fill chamber 35, 135 relatively rapidly, even where the hydraulic oil is relatively viscous. Further, bore 58 and cavities 57, 157 provide a relatively large initial contact area for hydraulic fluid, further facilitating initiation of plunger movement.

The present description is for illustrative purposes only and should not be construed to narrow the scope of the appended claims. For instance, although the illustrated example is for varying an intake valve closing timing, other applications are suitable. For instance, other hydraulic actuators operate with different valving strategies and with hydraulic pressures sufficient to open the valve independent of cam angle. The disclosure also contemplates careless hydraulic actuators. Thus, those skilled in the art will appreciate that various modifications might be made to the presently disclosed embodiments without departing from the full and fair scope of the claims.

What is claimed is:

1. An engine comprising:

a gas exchange valve movable a travel distance from a seat;

a rocker arm operably coupled to said gas exchange valve;

a cam operably coupled to said rocker arm;

a hydraulic actuator operably coupled to said gas exchange valve, said hydraulic actuator including a fluid inlet, a fluid outlet separate from said fluid inlet, a chamber and a plurality of fluid passages including at least one fluid supply passage connecting said fluid inlet with said chamber and configured to supply fluid to said chamber for controlling a position of said gas exchange valve, said hydraulic actuator further including a snubber operable over a portion of said travel distance and disposed in a fluid passage of said actuator separate from said at least one fluid supply passage and having a restricted passage fluidly connecting said chamber and said fluid outlet over said portion of said travel distance.

2. The engine of claim 1 comprising:

a high pressure hydraulic rail;

another fluid supply passage fluidly connecting said hydraulic rail with said actuator via said fluid inlet;

a check valve in said supply passage operable to allow fluid to flow from said rail to said actuator and block fluid flow from said actuator to said rail;

a drain passage; and a valve disposed in said drain passage and operable to close the same, thereby maintaining said gas exchange valve in an open state.

3. The engine of claim 2 wherein said hydraulic actuator comprises a plunger and a body, said plunger being movable within said body and including a metering edge positionable between said fluid inlet and said fluid outlet;

said plunger and said body defining a chamber fluidly connected to said supply passage, said plunger being configured to maintain said gas exchange valve in an open state via a fluid pressure in said chamber;

said plunger is movable a first portion of said travel distance by expelling fluid from said chamber at least in part through an unrestricted passage, said metering edge being configured to block said unrestricted passage over a second portion of said travel distance;

said plunger being movable said second portion of said travel distance by expelling fluid from said chamber through said restricted passage of said snubber, wherein said restricted passage is defined by at least one of said plunger and said body.

4. The engine of claim 3 wherein said restricted passage is defined by said plunger said plunger, further including a cavity connecting to said chamber and a peripheral annulus, said restricted passage having a first end opening to said cavity and a second end opening to said annulus and fluidly connecting said chamber with said drain passage over at least said second portion of said travel distance, and wherein the at least one fluid supply passage connecting said inlet with said chamber is also disposed in said plunger.

5. The engine of claim 3 wherein said restricted passage is defined by said body and fluidly connects said chamber with said drain passage, said plunger further including said fluid supply passage.

6. An actuator for a gas exchange valve comprising:

a body having a fluid inlet and a fluid outlet;

a plunger reciprocable in said body and having a travel distance between an advanced position and a retracted position;

said plunger and said body defining a chamber fluidly connected to said inlet via at least one fluid supply passage;

a flow restriction orifice disposed in at least one of said plunger and said body in a fluid passage defined by the at least one of said plunger and said body and separate from said at least one fluid supply passage;

said chamber is in unrestricted fluid communication with said outlet over a first portion of said travel distance, and in restricted fluid communication with said outlet by way of said orifice over at least a second portion of said travel distance.

7. The actuator of claim 6 wherein said orifice is defined by said body and fluidly connects said chamber and said fluid outlet.

8. The actuator of claim 7 wherein said plunger blocks fluid communication between said chamber and said fluid outlet over said second portion of said travel distance.

9. The actuator of claim 8 wherein said plunger defines a bore fluidly connecting said chamber with said fluid inlet.

10. The actuator of claim 6 wherein said orifice is defined by said plunger and fluidly connects said chamber and said fluid outlet over at least said second portion of said travel distance, said plunger further including a peripheral annulus and a restricted passage wherein said orifice is disposed, said restricted passage having an end opening at said peripheral annulus.

11. The actuator of claim 10 wherein said plunger restricts fluid communication between said chamber and said fluid outlet over said second portion of said travel distance, via a metering edge of said plunger positionable between said fluid inlet and said fluid outlet.

12. The actuator of claim 11 comprising:

a bore extending axially in said plunger, said bore defining a sub-chamber;

said at least one fluid supply passage being defined by said plunger and fluidly connecting said fluid inlet with said sub-chamber; and said annulus fluidly connecting said orifice with said fluid outlet over said second portion of said travel distance.

13. An actuator for a gas exchange valve comprising:

a body having a fluid inlet and a fluid outlet;

a housing having a supply passage in communication with said fluid inlet, and a drain passage in communication with said fluid outlet;

a plunger reciprocable in said body and having a travel distance between an advanced position and a retracted position; and a flow restriction orifice disposed in at least one of said plunger and said body;

said plunger and said body defining a chamber;

said chamber is in unrestricted fluid communication with said outlet over a first portion of said travel distance, and in restricted fluid communication with said outlet by way of said orifice over at least a second portion of said travel distance;

said orifice is defined by said body and fluidly connects said chamber and said fluid outlet;

said plunger blocks fluid communication between said chamber and said fluid outlet over said second portion of said travel distance;

said plunger defines a bore fluidly connecting said chamber with said fluid inlet;

said body being positioned in said housing, and including an annular seal therewith, wherein said fluid inlet is disposed in said housing at a first side of said seal and said fluid outlet is disposed in said housing at a second side of said seal;

said bore providing fluid communication between said supply passage and said drain passage over said first portion of said travel distance.

14. A method of reducing valve seating impact velocity comprising the steps of:

operably coupling a valve to a hydraulic actuator that includes a plunger and at least one fluid supply passage configured to supply fluid to a chamber for actuating the plunger;

moving the valve toward its seat at least in part by moving the plunger toward a retracted position at least in part by expelling fluid from the chamber through an unrestricted passage in a body, the plunger being reciprocable in the body; and slowing the valve as it approaches its seat at least in part by expelling the fluid from the chamber through a restricted passage disposed in at least one of the body and the plunger and in a fluid passage defined by at least one of the body and the plunger which is separate from the at least one fluid supply passage.

15. The method of claim 14 comprising blocking a passage with a metering edge of the plunger as the valve approaches the seat, the metering edge being positionable between a fluid inlet and a fluid outlet of the body.

16. The method of claim 14 wherein the restricted passage is disposed in the plunger.

17. The method of claim 14 wherein the restricted passage is disposed in the body.

* * * * *

UNITED STATES PATENT AND TRADEMARK OFFICE

CERTIFICATE OF CORRECTION

PATENT NO. : 7,228,826 B2
APPLICATION NO. : 10/926496
DATED : June 12, 2007
INVENTOR(S) : Chang It is certified that error appears in the above-identified patent and that said Letters Patent is hereby corrected as shown below:

In Column 8, Line 50, delete “careless” and insert -- camless --, therefor.

Signed and Sealed this

First Day of July, 2008

JON W. DUDAS
*Director of the United States Patent and Trademark Office*